US006483417B1

(12) United States Patent
Guthrie et al.

(10) Patent No.: US 6,483,417 B1
(45) Date of Patent: Nov. 19, 2002

(54) FUSEHOLDER CONTACT

(75) Inventors: David Allen Guthrie, Goldsboro, NC (US); Douglas Scott May, Garner, NC (US); Nancy Darlene Amburgey, Marthasville, MO (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 09/513,599

(22) Filed: Feb. 25, 2000

(51) Int. Cl.[7] ..... H01H 85/22; H01H 85/02

(52) U.S. Cl. ..... 337/188; 337/186; 337/187; 337/194; 337/268

(58) Field of Search ..... 337/180, 181, 337/186–188, 194, 195, 213, 251–253, 226, 268

(56) References Cited

U.S. PATENT DOCUMENTS 2,187,427 A * 1/1940 Middleton ..... 200/129
2,207,837 A * 7/1940 Sundt ..... 200/129
2,614,190 A * 10/1952 Conrad ..... 200/115.5
2,758,295 A * 8/1956 Sundt ..... 340/250
3,243,551 A * 3/1966 Hollins ..... 200/119
3,828,291 A * 8/1974 Urani ..... 337/201
4,202,589 A * 5/1980 Reavis, Jr. et al. ..... 339/97 R
4,390,225 A * 6/1983 Coyne et al. ..... 339/88 R
4,448,476 A * 5/1984 Perlman et al. ..... 339/203
4,504,815 A * 3/1985 Harwath ..... 337/201
4,762,509 A * 8/1988 Schaefer ..... 439/621

* cited by examiner

*Primary Examiner*—Anatoly Vortman
(74) *Attorney, Agent, or Firm*—Armstrong Teasdale LLP

(57) ABSTRACT

A bottom contact assembly for push-in connection with a line wire includes a bottom contact, a spring element and a spacer element. The bottom contact includes a base portion with gripping teeth for push-in connection of the line wire, and a rounded channel portion for engaging an end cap of a fuse element member. Positioning tabs extending from the base portion facilitate positioning of the base portion within the spacer element. The bottom contact assembly may be pre-assembled and inserted into an integral fuseholder body to reduce manufacturing costs.

18 Claims, 5 Drawing Sheets

FUSEHOLDER CONTACT

BACKGROUND OF THE INVENTION

This invention relates generally to fuseholders, and, more particularly, to fuseholders with push-in contacts.

Fuses are widely used overcurrent protection devices for protecting electrical components and subsystems from damaging fault currents. Fuses typically include a fusible link extending between electrical conductors, or contacts, for connection to a circuit. When current flowing through the fuse exceeds a predetermined limit, the fusible link melts, thereby opening the fuse and isolating downstream electrical components by preventing current from flowing through the fuse contacts.

For certain fuse and fuseholder applications, such as, for example, fluorescent lighting applications, push-in contacts, or push-in connections, are desirable. Push-in connections receive and engage stripped wires through a push-in receptacle. Thus, a firm electrical and mechanical connection results without requiring additional connectors, such as wire nuts, thereby saving both material and labor costs in manufacturing and installing fuseholders.

At least one type of known fuseholder includes push-in connections for both line and load connections. Assembly of this type of fuseholder typically involves a two piece fuseholder body, and hence is rather complicated and requires a manual assembly process. Manually assembly of push-in connection fuseholders, however, undesirably increases manufacturing costs, and the resultant expense of the fuseholders may outweigh their convenience to many consumers.

Accordingly, it would be desirable to provide a simplified contact assembly for a fuseholder with push-in line and load connections to reduce manufacturing costs.

BRIEF SUMMARY OF THE INVENTION

In an exemplary embodiment of the invention, a bottom contact for use in a push-in connection fuseholder having an integral fuseholder body includes a base portion adapted to engage a line wire connection and a rounded channel portion extending therefrom. The channel portion is adapted for engaging a fuse element member inserted within the fuseholder body before the fuseholder is wired to line and load connections.

A spring element is contained within the rounded channel portion and is retained by, or engaged to, a tab that extends upwardly from a bottom of the rounded channel. The spring element ensures electrical contact between the bottom contact, a top contact at the top of the fuseholder body, and a fuse element member extending therebetween when the fuseholder is assembled. A spacer element ensures proper positioning of the bottom contact within the fuseholder body until the fuse element member is installed.

The bottom contact, spring element and spacer element may be pre-assembled into a bottom contact assembly and inserted into an integral fuseholder body. After the bottom contact is inserted into the fuseholder body, the fuse element member is inserted into the spacer element. When a fuse element member is inserted, whether prior to wiring the fuseholder or after the fuseholder is wired, an endcap of the fuse element member compresses the spring element, which exerts a countering force to engage the top contact positioned at a top end of the fuseholder body with an opposite endcap of the fuse element member. The top contact also includes a push-in contact for a load wire.

Therefore, the bottom contact permits a convenient and easily assembled fuseholder for push-in engagement of a line wire while utilizing a cost effective integral fuseholder body.

DETAILED DESCRIPTION OF THE INVENTION

Figure 1:
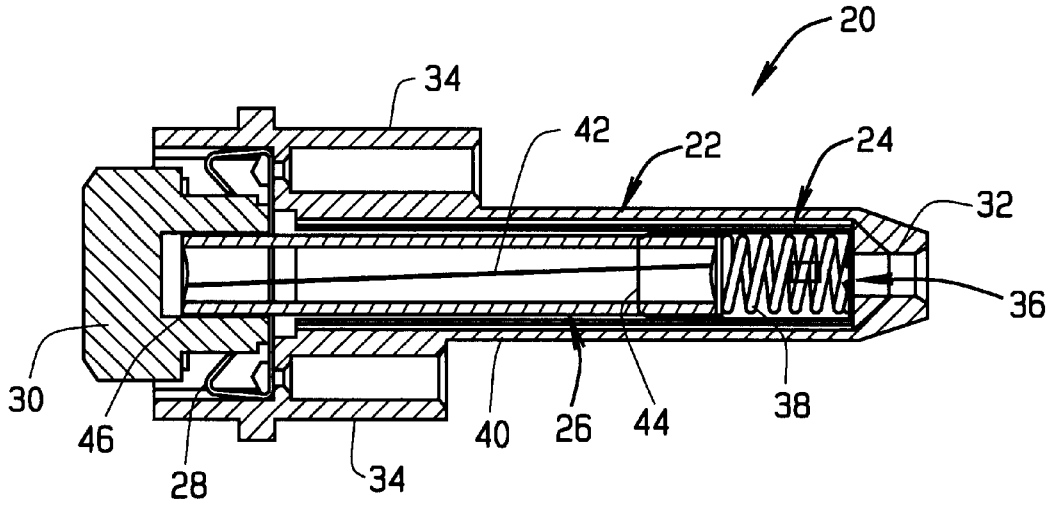
FIG. 1 is a cross sectional view of a push-in contact fuseholder with a fuse installed.

FIG. 1 is a cross sectional view of a push-in contact fuseholder 20 including an integral fuseholder body 22, a bottom contact assembly 24, a fuse element member 26, a push-in top contact 28, and an insulated cap 30, which in one embodiment is permanently attached to fuse element member 26. Fuseholder body 22 includes a bottom receptacle 32 for receiving a pre-stripped line wire (not shown in FIG. 1), and two top receptacles 34 for receiving a pre-stripped load wire (not shown in FIG. 1). While two top receptacles 34 are provided for more flexibility in wiring fuseholder 20, one top receptacle 34 is sufficient to accept the load wire, and more than two top receptacles 34 could be provided for increased wiring flexibility.

Bottom contact assembly 24 includes a push-in bottom contact 36, a spring element 38, and a spacer element 40. Bottom contact assembly 24 receives and engages the line wire and forms an electrical connection through known fuseholder element member 26 including a fusible link 42 extending between a bottom electrically conductive endcap 44 and a top electrically conductive endcap 46. In a particular embodiment, insulated cap 30 is permanently mounted to fuse element top endcap 46 which couples to fuseholder body 22, but in alternative embodiments, insulated cap 30 is separately inserted over fuse element top endcap 46 and is coupled to fuseholder body 22 to securely retain fuse element member 26 within fuseholder body 22.

Fuse element bottom endcap 44 engages bottom contact assembly 24 and forms an electrical connection between bottom contact 36 and bottom endcap 44. Top endcap 46 engages top contact 28 and forms an electrical connection between top endcap 46 and top contact 28. When the line wire is connected to push-in bottom contact 36 and the load wire is connected to top contact 28, a current path is established through fusible link 42 to protect electrical components attached to the load wire from overcurrent conditions. When current flowing through fusible link 42 exceeds a predetermined threshold, fusible link 42 melts or opens and prevents current from flowing to the load wire.

Figure 2:
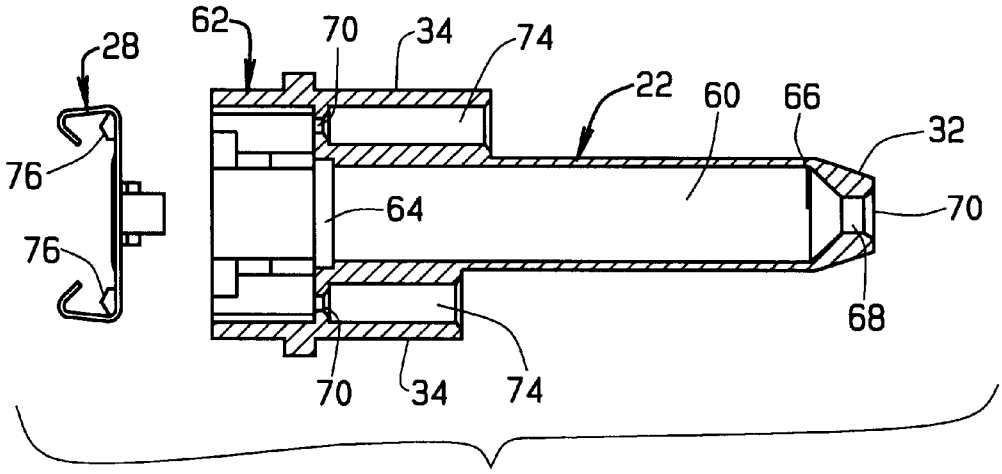
FIG. 2 is a cross sectional exploded view of a portion of the fuseholder shown in FIG. 1.

FIG. 2 is a cross sectional exploded view of integral, i.e., one piece, fuseholder body 22 and top contact 28. Fuseholder body 22 is integrally molded from a known non-electrically conductive material according to known methods and includes a cylindrical central bore 60 extending from bottom receptacle 32, top receptacles 34 extending on either side of central bore 60, and a top segment 62 extending from a top end 64 of central bore 60 and top receptacles 34. A bottom end 66 of central bore 60 includes a conical portion 68 than forms a stop for bottom contact assembly 24 (shown in FIG. 1). Bottom receptacle 32 includes a tapered opening 70 to facilitate insertion of a line wire (not shown in FIG. 2), and top receptacles 34 also include tapered openings 70 extending from cylindrical bores 74 to top segment 62 to facilitate insertion of a stripped load wire (not shown in FIG. 2).

Top contact 28 is fabricated from an electrically conductive material, such as brass, and includes two gripper elements 76 aligned with top receptacle 34 tapered openings 70 when top contact 28 is inserted into top segment 62. Gripper elements 76 flex and engage the stripped load wire as it is inserted through one of top receptacles 34. In alternative embodiments, top contact 28 is configured to correspond to alternative embodiments of fuseholder body 22 with varying numbers and configuration of top receptacles 34 to ensure proper alignment and push-in contact engagement with each top receptacle 34.

Figure 3:
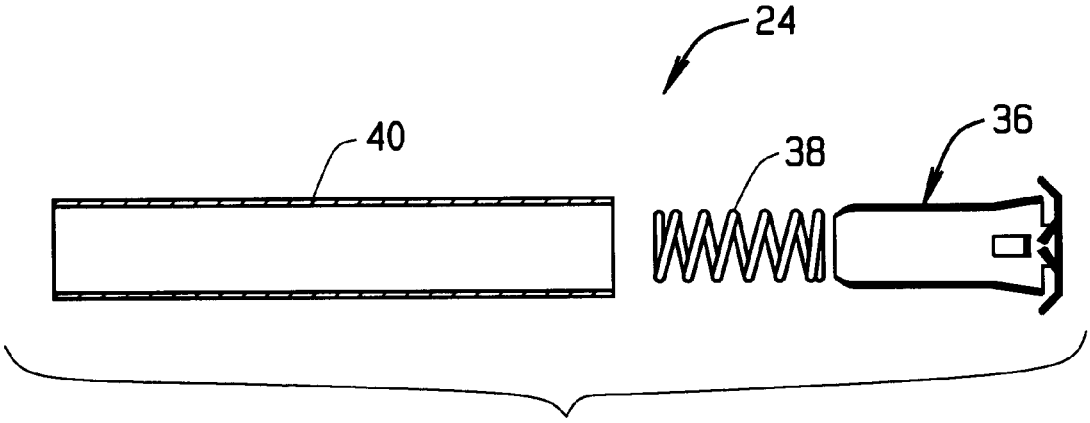
FIG. 3 is an exploded view of a bottom contact assembly for the fuseholder shown in FIG. 1.

FIG. 3 is an exploded view of bottom contact assembly 24 including bottom contact 36, spring element 38, and spacer element 40. Spacer element 40 is a cylindrical tube complementary shaped and dimensioned for insertion into fuseholder body central bore 60 (shown in FIG. 2) and is fabricated from a non-electrically conducting material according to known methods. Spring element 38 is a conventional spring fabricated from known materials and known techniques. It is contemplated that in alternative embodiments other known spacer elements and spring elements may be employed without departing from the scope of the present invention.

Figure 4:
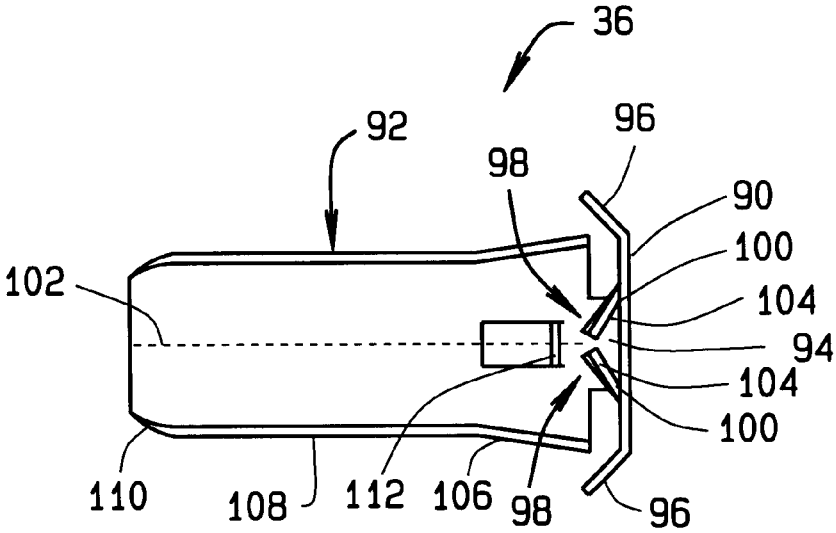
FIG. 4 is top plan view of a bottom contact for the bottom contact assembly shown in FIG. 3.

FIG. 4 is top plan view of bottom contact 36 formed from an electrically conductive material, such as brass, according to known methods and techniques. Bottom contact 36 includes a flat base portion 90, a rounded channel portion 92, and a connector portion 94 extending from base portion 90. A pair of positioning tabs 96 extend obliquely from base portion 90 toward channel portion 92. Two gripping teeth 98 extend obliquely from base portion 90 toward channel portion 92 to engage and grip a stripped line wire (not shown in FIG. 4). In one embodiment, gripping teeth 98 are formed by punching three sides of two rectangular tabs 100 from base portion 90 and bending each tab 100 toward channel portion 92 so that gripping teeth 98 are approximately centered about a longitudinal axis 102 of bottom contact 36. Gripping teeth 98 also include inwardly bent corners 104 to form a three sided engagement surface (not shown in FIG. 4) to enhance engagement of gripping teeth 98 with the line wire.

Channel portion 92 includes an outwardly flared portion 106, i.e., flared away from longitudinal axis 102, extending from base portion 90, a central portion 108 extending from flared portion 106, and an inwardly tapered portion 110, i.e., tapered toward longitudinal axis 102, extending from central portion 108. In one embodiment, a rectangular spring element engagement tab 112 is punched from channel portion 92 on three sides and extends upwardly substantially perpendicularly to bottom contact longitudinal axis 102.

Figure 5:
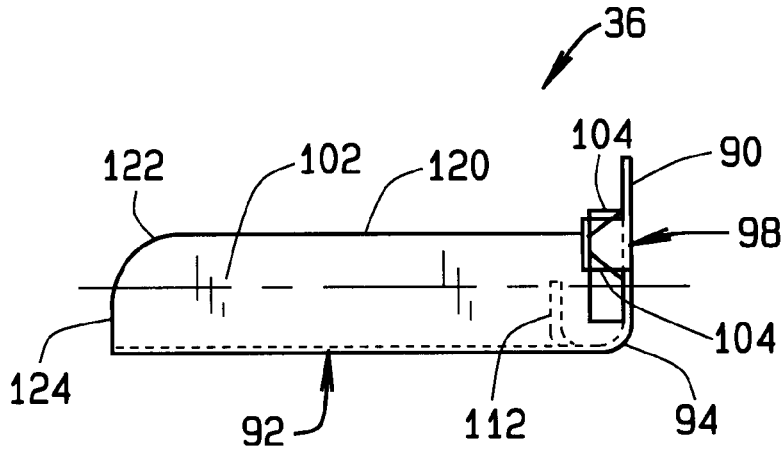
FIG. 5 is a side elevational view of the bottom contact shown in FIG. 4.

FIG. 5 is a side elevational view of bottom contact 36 including upright base portion 90 extending from connector portion 94 and extending substantially perpendicularly to longitudinal axis 102. Spring element engagement tab 112 extends from channel portion 92 substantially parallel to upright base portion 90. Gripping teeth 98 including bent corners 104 extend from base portion 90 adjacent a top edge 120 of channel portion 92. Top edge 120 extends substantially parallel to bottom contact longitudinal axis 102. A rounded corner 122 joins an end 124 of bottom contact 36 and bottom contact top edge 120 to facilitate assembly of bottom contact assembly 24 (shown in FIG. 3).

Figure 6:
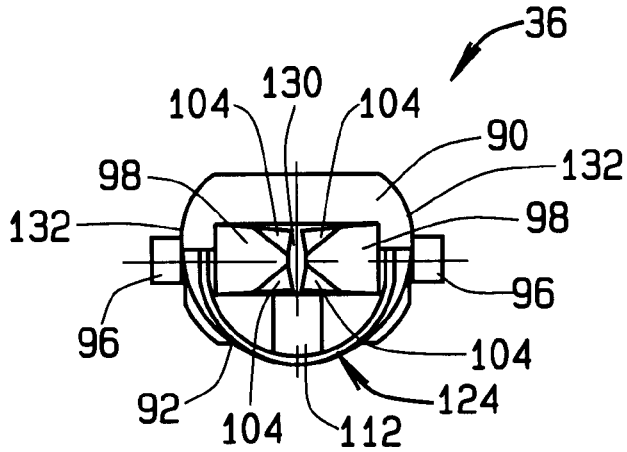
FIG. 6 is a front elevational view of the bottom contact shown in FIG. 4.

FIG. 6 is a front elevational view of bottom contact 36 looking through bottom contact tapered end 124. In one embodiment, flat base portion 90 is medallion shaped and includes a diamond shaped opening 130 formed by bent comers 104 of gripping teeth 98 for insertion of a line wire (not shown in FIG. 6). Positioning tabs 96 extend from side edges 132 of base portion 90 adjacent rounded channel portion 92. In one embodiment, rounded channel portion 92 is substantially semicircular in rounded channel central portion 108 (shown in FIG. 4) and flared outwardly, i.e., away from longitudinal axis 102 (shown in FIGS. 4 and 5), in rounded channel flared portion 106 (shown in FIG. 4). Spring element engagement tab 112 extends upwardly from channel portion 92 toward gripping teeth 98.

Figure 7:
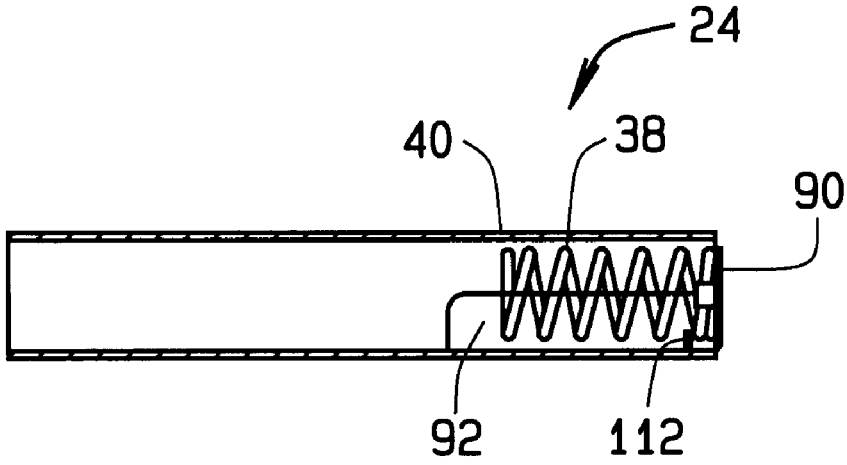
FIG. 7 is a side cross sectional schematic of the assembled bottom contact assembly shown in FIG. 3.

FIG. 7 is a side cross sectional schematic of assembled bottom contact assembly 24. Spring element 38 is inserted into bottom contact rounded channel portion 92, and channel portion 92 is inserted into spacer element 40. Spring element 38 engages spring element engagement tab 112 and maintains spring element 38 in relative position to bottom contact base portion 90.

Figure 8:
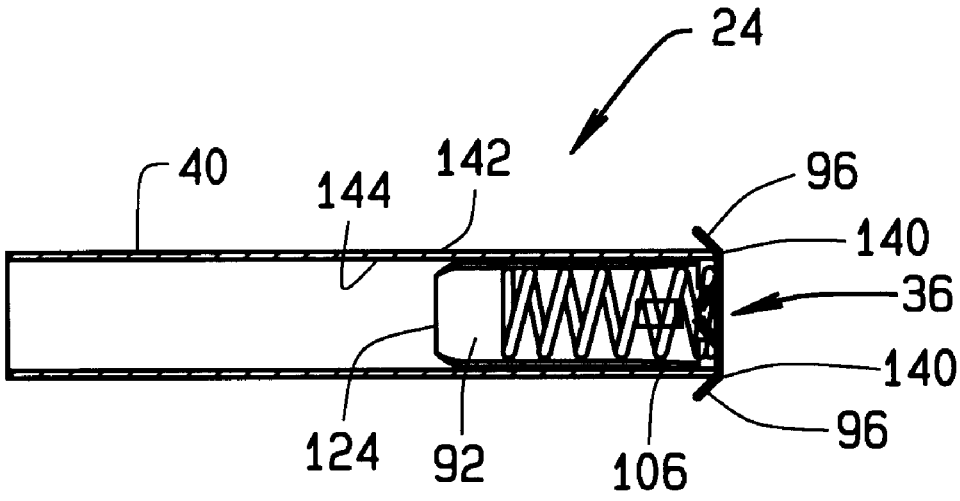
FIG. 8 is a top cross sectional schematic of the assembled bottom contact assembly shown in FIG. 7.

FIG. 8 is a top cross sectional schematic of assembled bottom contact assembly 24 illustrating positioning tabs 96 contacting an end 140 of spacer element 40. As bottom contact assembly 24 is inserted into fuseholder body central bore 60 (shown in FIG. 2), positioning tabs 96 are bent around an exterior surface 142 of spacer element 40 and extend substantially parallel to spacer element exterior surface 142. Thus, positioning tabs 96 maintain bottom contact 36 in position relative to spacer element 40. Flared portion 106 of channel portion 92 also facilitates proper positioning of bottom contact 36 relative to spacer element 40 during assembly operations by engaging an interior surface 144 of spacer element 40. In addition, tapered end 124 of bottom contact channel portion 92 extends only partially through spacer element 40. In a particular embodiment, bottom contact channel portion 92 extends through spacer element 40 about 40% of a length L of spacer element. In various alternative embodiments, varying lengths of spacer elements relative to bottom contact channel portion are employed within the scope of the invention.

Figure 9:
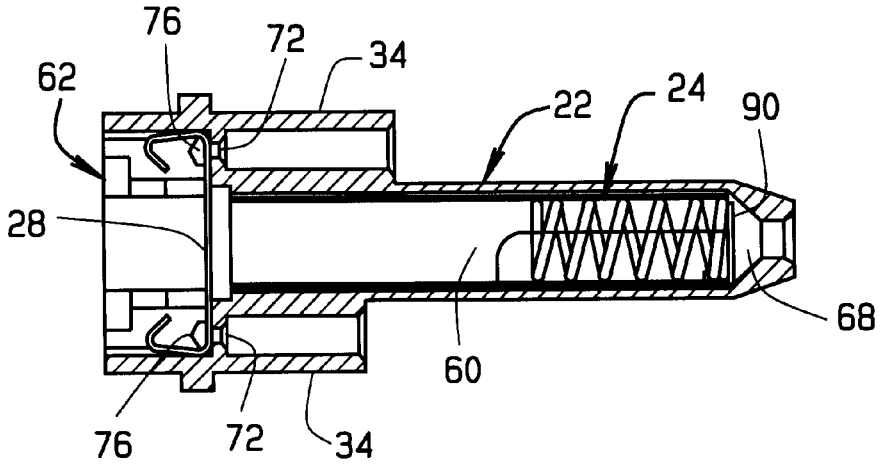
FIG. 9 is a view similar to FIG. 1 with the fuse removed.

FIG. 9 illustrates contact assembly 24 inserted in fuseholder body 22 central bore 60 until bottom contact base portion 90 contacts fuseholder body conical portion 68. Top contact 28 is inserted into top segment 62 and top contact gripper elements 76 are aligned with tapered openings 70 of top receptacles 34 for engagement with a load wire (not shown in FIG. 9).

Figure 10:
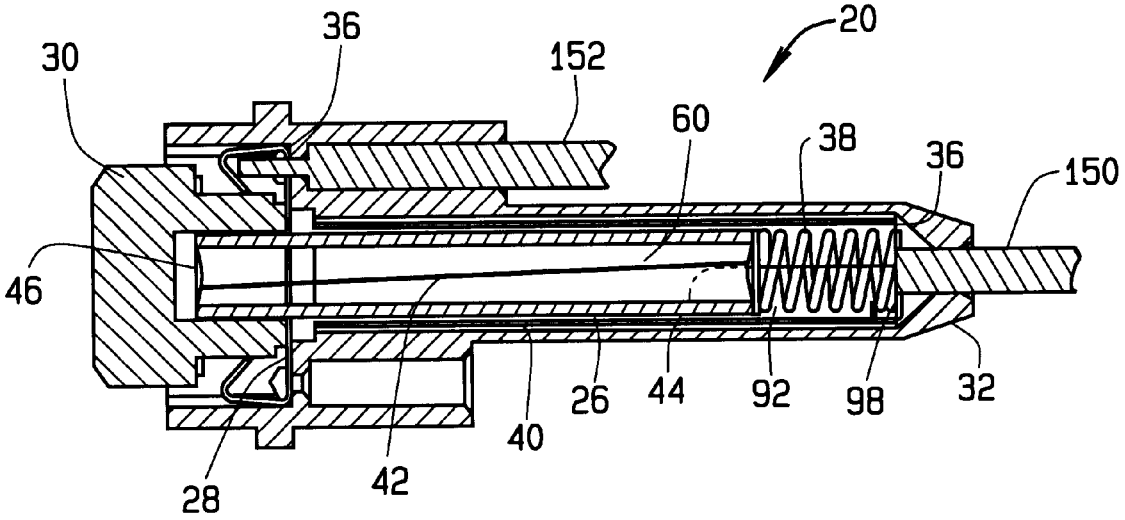
FIG. 10 is a cross sectional side view of the fuseholder and fuse shown in FIG. 1 wired for operation.

FIG. 10 is a cross sectional side view of completely assembled fuseholder, insulated cap 30, and installed fuse 20. Fuse element member 26 is inserted into fuseholder body central bore 60 through top contact 28 and through spacer element 40. Bottom contact channel portion 92 contacts fuse element bottom endcap 44, and fuse member bottom endcap 44 compresses spring element 38 as fuse element member 26 is inserted, thereby creating a current path through fuse element bottom endcap 44 and bottom contact channel portion 92 rather than creating a current path through higher resistance spring element 38.

In a particular embodiment, cap 30 is mechanically coupled to or otherwise bonded to fuseholder body 22 to contain fuse element member 26 within fuseholder body 22. In an alternative embodiment cap 30 is mechanically coupled to or otherwise bonded to fuse element member 26 and is adapted for coupling to cap top segment to contain fuse element member 26 within fuseholder body 22. Spring element 38 forces fuse element member 26 upward to ensure the integrity of electrical contact between fuse element top endcap 46 and top contact 28. Spacer element 40 prevents direct contact of top contact 28 and bottom contact 36, and maintains bottom contact assembly 24 in position within fuseholder body 22 prior to installation of fuse element member 24.

A stripped line wire 150 is press fit into fuseholder body bottom receptacle 32 and engaged by base portion gripping teeth 98. A stripped load wire 152 is press fit into fuseholder body top receptacle 34 and engaged by top contact gripper elements 76. With the push-in contact connections, fuseholder 20 is quickly and easily installed without requiring wire connectors, such as wire nuts.

Therefore, an easily assembled fuseholder including push-in contacts for both line and load connections is provided that utilizes an integral fuseholder body, thereby reducing manufacturing and assembly costs of the fuseholder.

While the invention has been described in terms of various specific embodiments, those skilled in the art will recognize that the invention can be practiced with modification within the spirit and scope of the claims.

What is claimed is:

1. A bottom contact for forming an electrical connection with a top contact through a fuse element member contained in a one-piece fuseholder body, said bottom contact comprising:

a base portion comprising a plurality of gripping teeth for engaging a line wire; and a rounded channel portion extending from said base portion, said channel portion adapted for engaging the fuse element member.

2. A bottom contact in accordance with claim 1 wherein said rounded channel portion is substantially semicircular.

3. A bottom contact in accordance with claim 2 wherein said rounded channel portion comprises a flared portion adjacent said base.

4. A bottom contact in accordance with claim 3 wherein said rounded channel portion comprises a longitudinal axis, said flared portion extending away from said longitudinal axis.

5. A bottom contact in accordance with claim 1 wherein said rounded channel portion comprises a longitudinal axis, said base portion comprises at least one positioning tab extending obliquely from said base portion toward said longitudinal axis.

6. A bottom contact in accordance with claim 1 wherein said rounded channel portion comprises a longitudinal axis and a tapered portion, said tapered portion tapered toward said longitudinal axis.

7. A fuseholder bottom contact assembly for insertion into a one-piece fuseholder body, said bottom contact assembly comprising:

a bottom contact comprising a rounded channel portion and a base comprising a plurality of gripping teeth for engaging a pre-stripped line wire;

a spacer element for positioning said fuseholder bottom contact assembly when said fuseholder bottom contact assembly is inserted into said fuseholder body; and a spring element within said rounded channel portion.

8. A fuseholder bottom contact assembly in accordance with claim 7 wherein said spacer element comprises an exterior surface, at least a portion of said base portion extending substantially parallel to said exterior surface when said bottom contact is inserted into said spacer element.

9. A fuseholder bottom contact assembly in accordance with claim 8 wherein said base portion comprises at least one positioning tab, said at least one positioning tab bent around said exterior surface when said bottom contact is inserted into said spacer element.

10. A fuseholder bottom contact assembly in accordance with claim 9 wherein said at least one tab extends obliquely from said base portion before said bottom contact is inserted into said spacer element.

11. A fuseholder bottom contact assembly in accordance with claim 7 wherein said spacer element comprises an interior surface, and said rounded channel portion comprises a flared portion adjacent said base portion, said flared portion engaging said interior surface when said bottom contact is inserted into said spacer element.

12. A fuseholder bottom contact assembly in accordance with claim 7 wherein said rounded channel portion comprises a spring element engagement tab adjacent said base portion.

13. A fuseholder bottom contact assembly in accordance with claim 7 wherein said rounded channel portion comprises a tapered portion.

14. A fuseholder bottom contact assembly in accordance with claim 7 wherein said rounded channel is approximately semicircular.

15. A method for assembling a fuseholder adapted for push-in connection with a line wire with an integral fuseholder body and a bottom contact assembly, the fuseholder body including a top portion, a bottom portion, and a central bore therethrough, the bottom contact including a spacer element complementary in shape to the fuseholder body bore, a spring element, and a bottom contact including a rounded channel portion and a base portion adapted for push-in connection, the base portion including positioning tabs, the rounded channel portion including a flared portion and a spring element engagement tab, said method comprising the steps of:

inserting the spring element within the rounded channel of the bottom contact;

engaging the spring element with the spring element engagement tab of the bottom contact;

inserting the bottom contact and engaged spring element into the spacer element until the flared end and positioning tabs engage the spacer element; and inserting the spacer element into the fuseholder body so that the bottom contact push-in contact is positioned at the fuseholder body bottom.

16. A method in accordance with claim 15, the fuseholder further including a fuse element member having an endcap, said method further comprising the step of inserting the fuse element member into the fuseholder body bore so that one of the endcaps is inserted into the bottom contact rounded channel portion, thereby compressing the spring element and forming an electrical connection between the bottom contact and the fuse element endcap.

17. A method in accordance with claim 16, the fuseholder further comprising a top contact and a cap, said method further comprising the steps of:

attaching the top contact to the top of the fuseholder body, thereby forming an electrical connection between the top contact and the fuse element member; and closing the top of the fuseholder body with the cap, thereby holding the top contact fuse element member, spacer member, spring element member, and bottom contact member in place within the fuseholder body bore.

18. A method in accordance with claim 15 wherein the step of inserting the spacer element into the fuseholder body further comprises the step bending the positioning tabs around the spacer element, thereby locking the bottom contact to the spacer element as the spacer element is inserted into the fuseholder body.

* * * * *